US012788189B2

(12) United States Patent
Schwartz et al.

(10) Patent No.: US 12,788,189 B2
(45) Date of Patent: Nov. 10, 2026

(54) BATHTUB WITH REVERSIBLE SIDE PANEL

(71) Applicant: Joseph Schwartz, Miami, FL (US)

(72) Inventors: Joseph Schwartz, Hollywood, FL (US); Gunter Felix, Hialeah, FL (US)

(73) Assignee: SPA WORLD CORPORATION, Miami, FL (US)

( * ) Notice: Subject to any disclaimer, the term of this patent is extended or adjusted under 35 U.S.C. 154(b) by 143 days.

(21) Appl. No.: 18/627,549

(22) Filed: Apr. 5, 2024

(65) Prior Publication Data

US 2025/0311892 A1 Oct. 9, 2025

(51) Int. Cl.
*A47K 3/02* (2006.01)

(52) U.S. Cl.
CPC ..... *A47K 3/02* (2013.01)

(58) Field of Classification Search
CPC ..... A47K 3/02; A47K 3/161
USPC ..... 4/584, 592–593, 595
See application file for complete search history.

(56) References Cited

U.S. PATENT DOCUMENTS 2,305,846 A * 12/1942 Coordes ..... A47K 3/02 4/593
2,427,375 A * 9/1947 Walker ..... A47K 3/04 4/584
2,528,432 A * 10/1950 Heckathorn ..... A47K 3/161 4/595
2,784,417 A * 3/1957 Strand ..... A47K 3/1605 52/309.4
2,841,795 A * 7/1958 Pelicano ..... A47K 3/02 4/592
2,919,449 A * 1/1960 Bowden ..... A47K 3/02 4/584
3,028,603 A * 4/1962 Rodman ..... A47K 3/161 4/584
5,208,924 A * 5/1993 Smith ..... A47K 3/02 4/584
5,619,760 A * 4/1997 Wang ..... A47K 3/04 4/584
5,864,898 A * 2/1999 Knapp ..... A47K 3/161 4/584
5,940,906 A * 8/1999 Halloran ..... A47K 3/161 4/584
6,269,494 B1 * 8/2001 Moretto ..... A47K 3/161 4/584
7,278,175 B2 * 10/2007 Torres ..... A47K 3/161 4/584
2009/0255050 A1 * 10/2009 Lebrun ..... A47K 3/161 4/584

* cited by examiner

*Primary Examiner* — David P Angwin
*Assistant Examiner* — William R Klotz
(74) *Attorney, Agent, or Firm* — Mark H. Francis; Heath M. Sargeant; Holland & Knight LLP

(57) ABSTRACT

A bathtub apparatus includes a bathtub body including a bottom, an interior sidewall, a top, and pair of opposing sides. The bathtub apparatus includes a reversible side panel configured to be interchangeably coupled to either of a first side and a second side of the bathtub body, wherein the first side and the second side define the pair of opposing sides of the bathtub body.

17 Claims, 11 Drawing Sheets

BATHTUB WITH REVERSIBLE SIDE PANEL

TECHNICAL FIELD

The present disclosure generally relates to a bathtub and, more particularly, for a bathtub with a reversible side panel that can be interchangeably coupled to either side of the bathtub.

BACKGROUND

Many modern bathtubs today are manufactured to accommodate typical drain locations. For example, bathtubs are typically manufactured with a "left" drain variant to account for the "left" drain placement, or a "right" drain variant to account for a "right" drain placement, where the direction of "left" or "right" is defined from an observer's perspective of the bathtub indicative of the drain location. Accordingly, many bathtub manufacturers produce duplicate bathtubs to meet both drain placements with paneling and edge features unique to each variant.

SUMMARY

In an embodiment, a bathtub apparatus may include a bathtub body including a bottom, an interior sidewall, a top, and pair of opposing sides. The bathtub apparatus may include a reversible side panel configured to be interchangeably coupled to either of a first side and a second side of the bathtub body, wherein the first side and the second side define the pair of opposing sides of the bathtub body.

One or more of the following features may be included. The reversible side panel may be interchangeably coupled to either of the first side and the second side of the bathtub body by sliding a top edge of the interchangeably reversible side panel under the edge of the top of the bathtub body on a respective side of the bathtub body to define a generally flat surface across the edge of the top of the bathtub body and the reversible side panel. The reversible side panel may be interchangeably coupled to a top of one of the first side and the second side of the bathtub body using one or more clips mounted under the edge of the top of the bathtub body. The bathtub body may include a bottom-mounted support frame with a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body. The reversible side panel may be interchangeably coupled to a bottom of either of the first side and the second side of the bathtub body using a coupling mechanism on at least one of the support frame rails. The coupling mechanism may include a magnetic coupling mechanism formed between a magnet positioned on a bottom portion of the reversible side panel and a magnet positioned on at least one of the support frame rails. The bathtub body may include a drain positioned on a left side of the bathtub body extending through the bottom of the bathtub body. The bathtub body may include a drain positioned on a right side of the bathtub body extending through the bottom of the bathtub body. The reversible side panel may include one or more removable access panels. The bathtub body may include an elongated aperture within the interior sidewall adjacent to the top of the bathtub body that extends through the interior sidewall of the bathtub body into an overflow channel coupled to a drain. The reversible side panel may be configured to be coupled to the first side of the bathtub body. The reversible side panel may be coupled to the first side of the bathtub body. The reversible side panel may be configured to be coupled to the second side of the bathtub body.

According to another embodiment, a bathtub apparatus may include a bathtub body including a bottom, an interior sidewall, a top, and pair of opposing sides. The bathtub apparatus may include a reversible side panel configured to be interchangeably coupled to either of a first side and a second side of the bathtub body. The first side and the second side may define the pair of opposing sides of the bathtub body. The reversible side panel may be interchangeably coupled to either of the first side and the second side of the bathtub body by sliding a top edge of the interchangeably reversible side panel under the edge of the top of the bathtub body on a respective side of the bathtub body to define a generally flat surface across the edge of the top of the bathtub body and the reversible side panel.

One or more of the following features may be included. The reversible side panel may be interchangeably coupled to a top of either of the first side and the second side of the bathtub body using one or more clips mounted under the edge of the top of the bathtub body. The bathtub body may includes a bottom-mounted support frame with a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body. The reversible side panel may be interchangeably coupled to a bottom of either of the first side and the second side of the bathtub body using a coupling mechanism on at least one of the support frame rails. The bathtub body may include a drain positioned on a left side of the bathtub body extending through the bottom of the bathtub body. The bathtub body may include a drain positioned on a right side of the bathtub body extending through the bottom of the bathtub body.

According to yet another embodiment, a bathtub apparatus includes a bathtub body having a bottom, a bottom-mounted support frame, an interior sidewall, a top, and pair of opposing sides. The bathtub apparatus may include a reversible side panel configured to be interchangeably coupled to either of a first side and a second side of the bathtub body, wherein the first side and the second side define the pair of opposing sides of the bathtub body. The reversible side panel may be interchangeably coupled to either of the first side and the second side of the bathtub body by sliding a top edge of the interchangeably reversible side panel under the edge of the top of the bathtub body on a respective side of the bathtub body to define a generally flat surface across the edge of the top of the bathtub body and the reversible side panel. The bathtub body may include a bottom-mounted support frame with a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF EXAMPLE EMBODIMENTS

Figure 1:
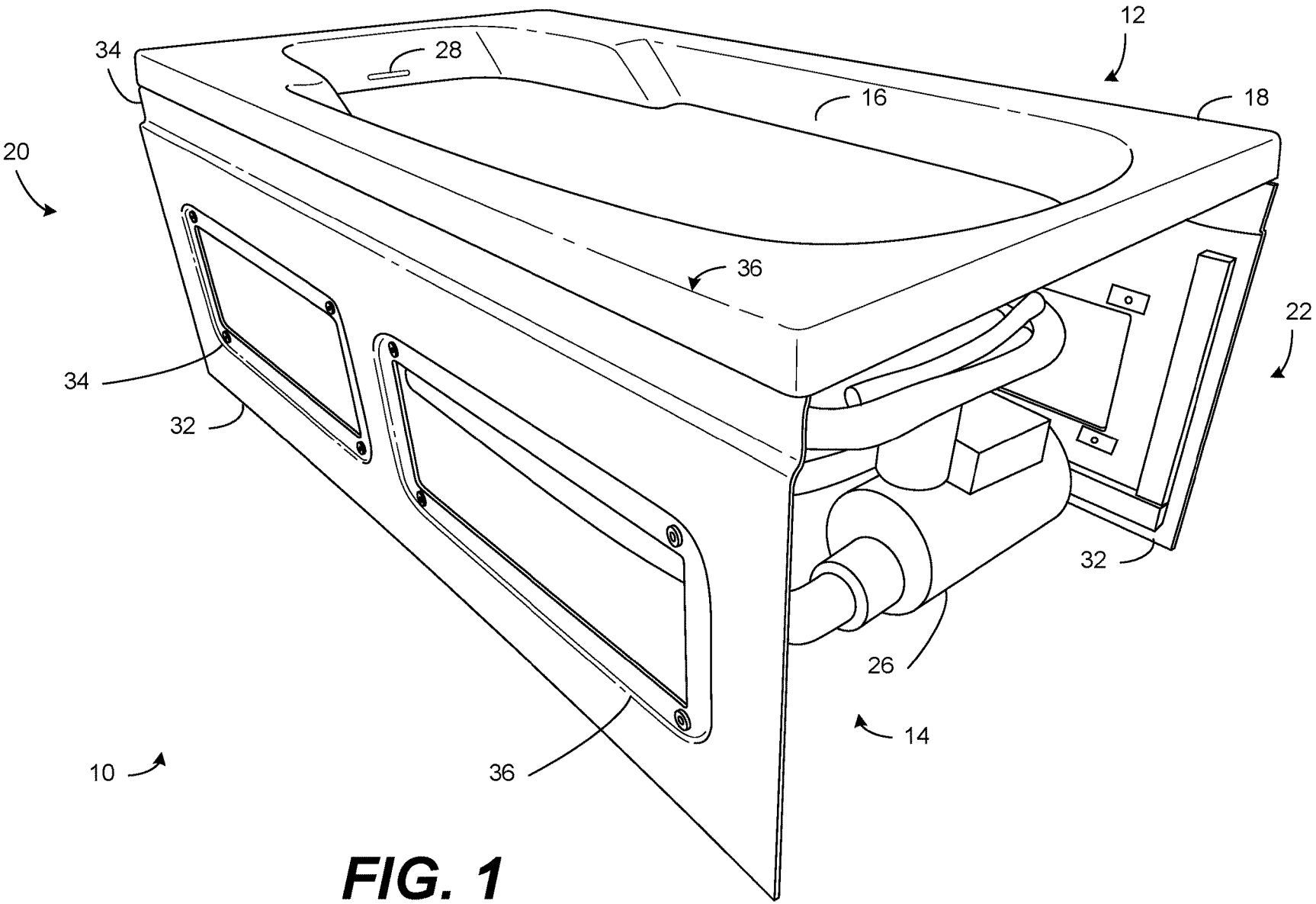
FIG. 1 is a perspective view of a bathtub apparatus according to an example embodiment.

In general, consistent with the present disclosure, a bathtub apparatus is provided with reversible side panels. For example, and referring generally to FIGS. 1 through 11, in some embodiments, a bathtub may include exposed sides that are covered with side panels. As will be discussed in greater detail below, embodiments of the present disclosure provide a reversible side panel that is interchangeably coupled to either side of the bathtub. In one embodiment, a single reversible side panel are coupled to the bathtub on an exposed side of the bathtub while the unexposed, opposite side is placed against a wall (or other fixture) regardless of the drain placement of the bathtub (i.e., left drain or right drain). In another embodiment, two reversible side panels are coupled to either side of the bathtub on two exposed sides of the bathtub regardless of the drain placement of the bathtub. Accordingly, the bathtub apparatus of the present disclosure is used for a front-finished left drain bathtub or a front-finished right drain bathtub using the same, interchangeable reversible side panel.

Referring to FIGS. 1-11 and in some implementations, a bathtub (e.g., bathtub 10) may be any volume or tank configured to hold liquid. As is known in the art, a bathtub may be made from any combination of plastics, fiberglass, stones, metals, etc. While the term "bathtub" may be used throughout the present disclosure, it will be appreciated that the bathtub apparatus of the present disclosure may be applied to any volume or tank.

In some embodiments, the bathtub (e.g., bathtub 10) includes a bathtub body (e.g., bathtub body 12). Bathtub body 12 generally includes the bathtub itself and includes a bottom (e.g., bottom 14), an interior sidewall (e.g., interior sidewall 16), a top (e.g., top 18), and pair of opposing sides (e.g., first side 20 and second side 22). Bottom 14 generally defines the floor of bathtub body 12. Interior sidewall 16 includes the interior sidewall of bathtub body 12 that is filled with water. In one embodiment, bathtub body 12 includes a drain (e.g., drain 24) positioned on a left side of bathtub body 12 extending through bottom 14 of bathtub body 12. In another embodiment, bathtub body 12 includes drain 24 positioned on a right side of bathtub body 12 extending through bottom 14 of bathtub body 12. As discussed above, conventional approaches to providing bathtubs for left or right drain placement include manufacturing entire left and right variants of a bathtub with finished paneling on an exposed side and without paneling on an unexposed, internal side. As will be discussed in greater detail below, embodiments of the present disclosure provide a bathtub with a reversible side panel that can be coupled interchangeably on either (or both) sides of the bathtub. In this manner, bathtub 10 can be deployed in either a left or right drain configuration with one or more of the same interchangeable reversible side panels.

In some embodiments, top 18 is the uppermost portion of bathtub body 12 that is generally smooth and flat providing a surface to sit or place items around the interior of bathtub body 12. Top 18 may be formed of porcelain, acrylic, fiberglass, metal, etc., and often includes a glossy or polished surface. As shown in FIG. 1, top 18 is generally rectangular with two long edges (e.g., edges on sides 20, 22) and two shorter edges. However, it will be appreciated that the shape and number of sides for top 18 may be dependent upon the shape and number of sides of bathtub body 12. For example and in one embodiment, bathtub body 12 and top 18 may include a quarter-circle shape with two perpendicular, straight edges and a rounded edge joining the two straight edges. In another example, bathtub body 12 and top 18 may be square shaped with sides of equal length. Accordingly, it will be appreciated that bathtub body 12 and top 18 may include various shapes and sizes within the scope of the present disclosure. In some embodiments, bathtub body 12 includes various plumbing, heating, cooling, and/or water jet features. For example and as shown in FIG. 1, bathtub body 12 includes a water jet system (e.g., water jet system 26) with a pump to circulate water through a series of jets positioned around interior sidewall 16.

Figure 2:
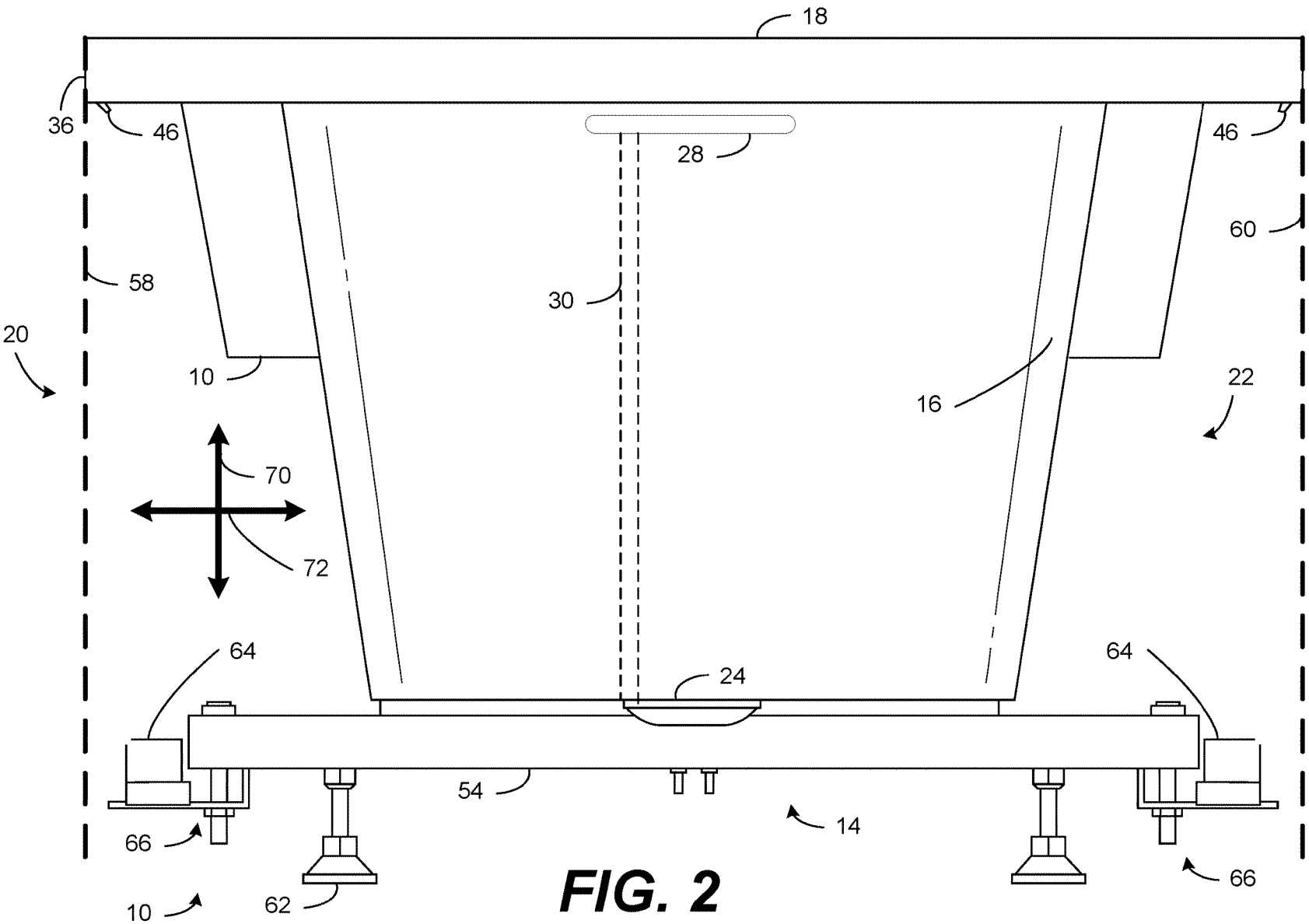
FIG. 2 is a front view of a bathtub apparatus according to an example embodiment.

In some embodiments, bathtub body 12 includes an elongated aperture (e.g., elongated aperture 28) within the interior sidewall adjacent to the top of the bathtub body that extends through the interior sidewall of the bathtub body into an overflow channel (e.g., overflow channel 30) coupled to a drain (e.g., drain 24). Referring also to FIG. 2, elongated aperture 28 is a slit-shaped aperture adjacent to top 18 that extends through interior sidewall 16 into overflow channel 30 that conveys excess liquid from the interior of bathtub apparatus 10 to drain 24. In some embodiments, overflow channel 30 includes piping or channeling between elongated aperture 28 and drain 24. Accordingly, bathtub body 12 may include a cavity under top 18 on the exterior of interior sidewall 16 for positioning various components, plumping, overflow channels, and/or other systems. As will be discussed in greater detail below, accessing the cavity under top 18 may include using removable access panels of a reversible side panel.

In some embodiments, bathtub apparatus 10 includes a reversible side panel (e.g., reversible side panel 32) configured to be interchangeably coupled to either of first side 20 and second side 22 of bathtub body 12. As discussed above, reversible side panel 32 is configured to be interchangeably coupled to either first side 20 or second side 22 (i.e., reversible side panel 32 is reversible and is couplable to both first side 20 and second side 22 without modification to bathtub body 12, top 18, or reversible side panel 32). The term "interchangeably coupled to either" does not limit reversible side panel 32 to exclusive coupling on only first side 20 or second side 22. Rather, the term "interchangeably coupled to either" means that reversible side panel 32 is capable of being coupled to first side 20 and is capable of being coupled to second side 22. Accordingly, reversible side panel 32 is reversible meaning it can be coupled on "reverse" or opposite sides (i.e., first side 20 and second side 22) of bathtub body 12. As shown in FIG. 1, first side 20 and second side 22 define a pair of opposing sides of bathtub body 12. In one embodiment, reversible side panel 32 is configured to be coupled to bathtub body 12 on first side 20. In another embodiment, reversible side panel 32 is configured to be coupled to bathtub body 12 on second side 22. In this manner, the same reversible side panel (e.g., reversible side panel 32) is interchangeably couplable to both first side 20 and second side 22.

Figure 3:
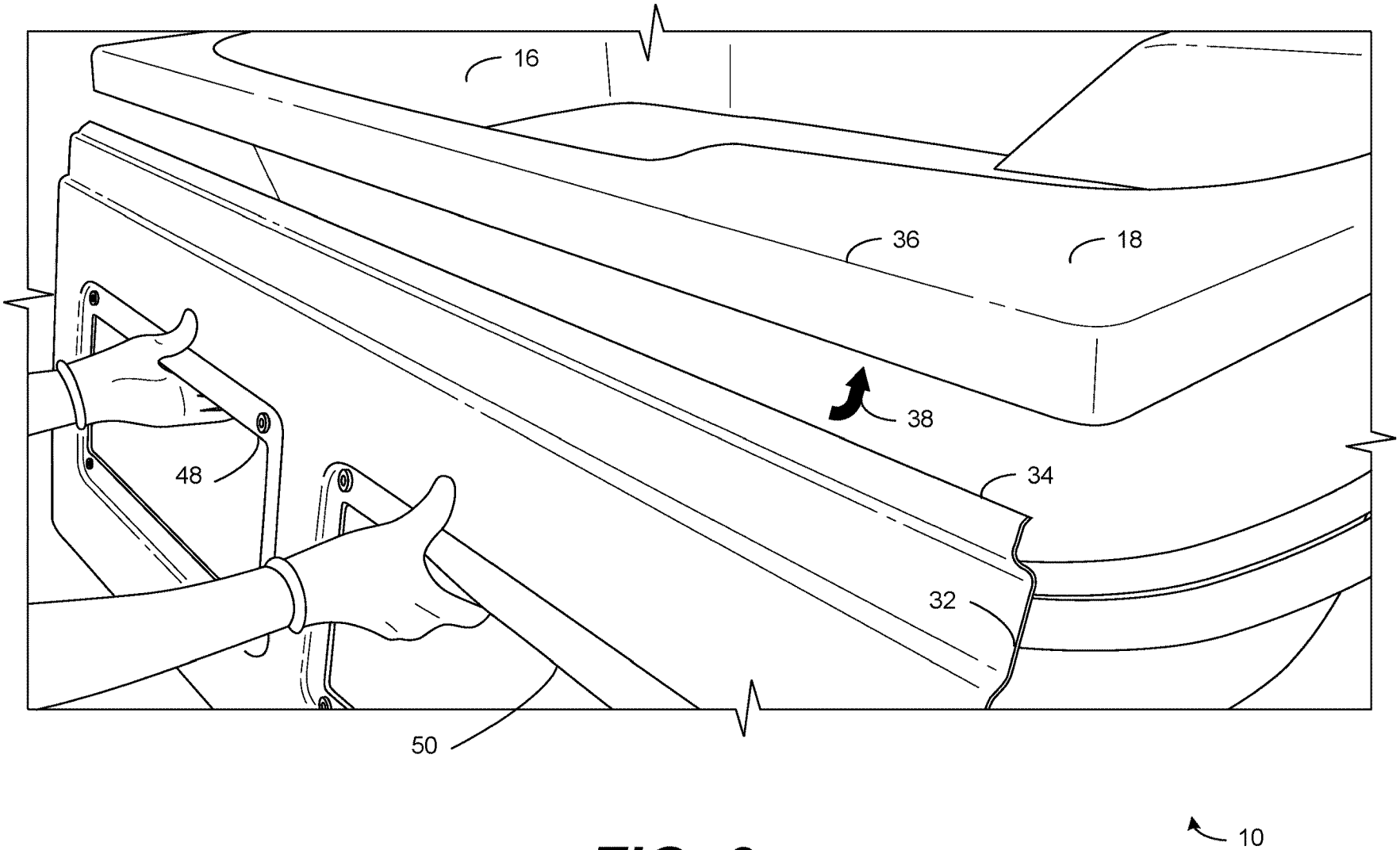
FIGS. 3-4 are perspective views of the coupling of a reversible side panel to a bathtub body according to an example embodiment.
Figure 4:
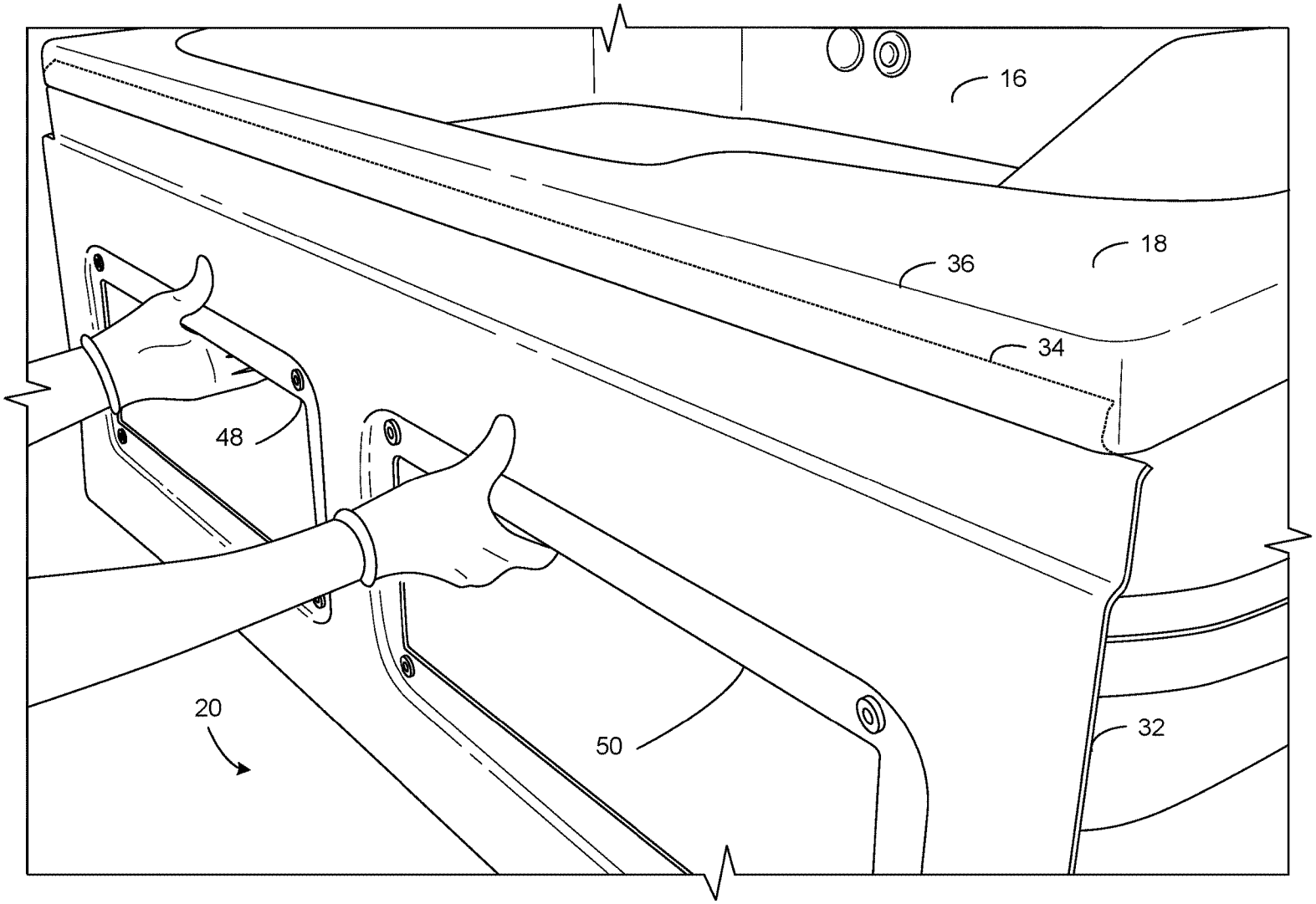
Figure 5:
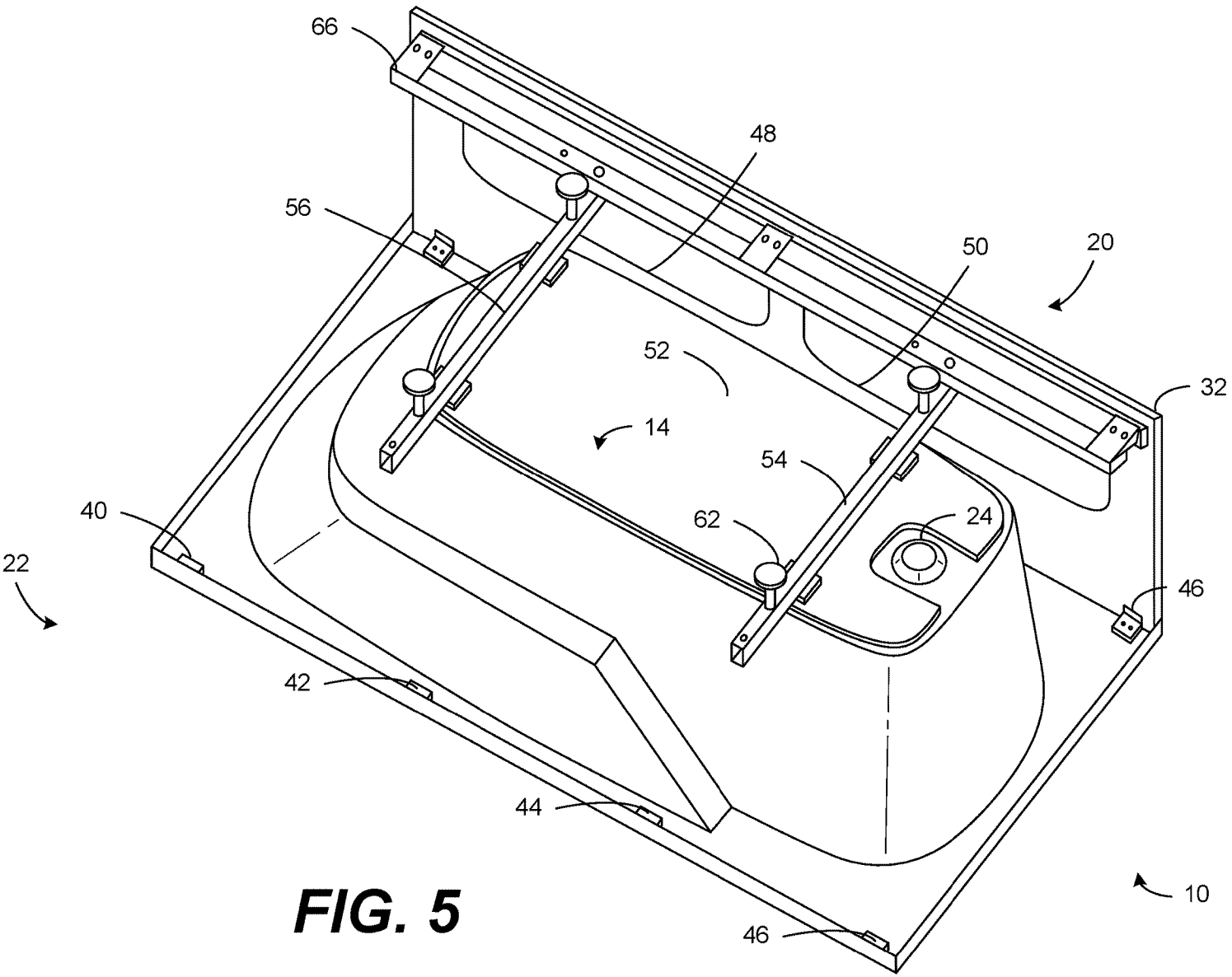
FIG. 5 is a bottom view of a bathtub apparatus according to an example embodiment.
Figure 6:
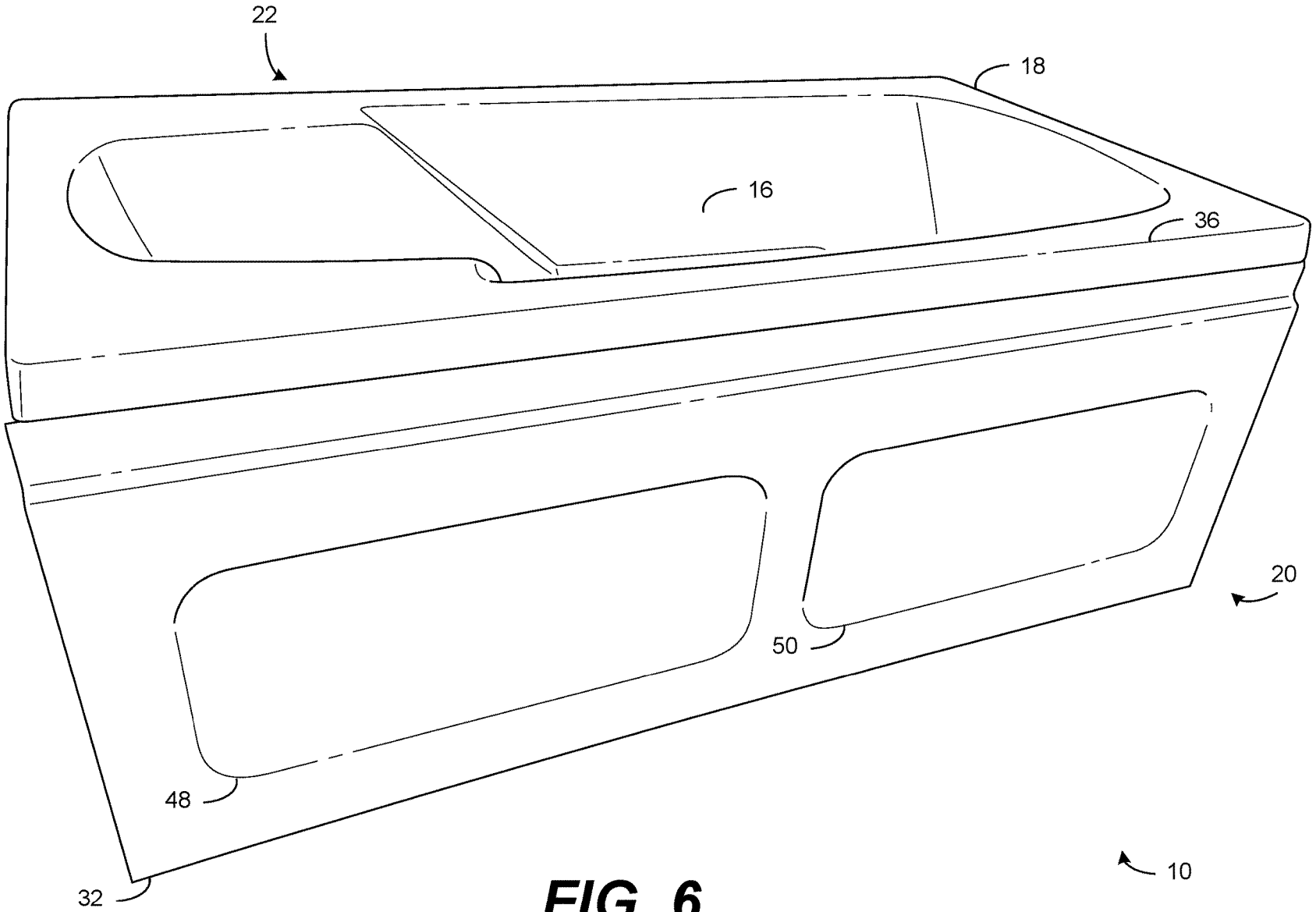
FIG. 6 is a side view of a bathtub apparatus according to an example embodiment.
Figure 7:
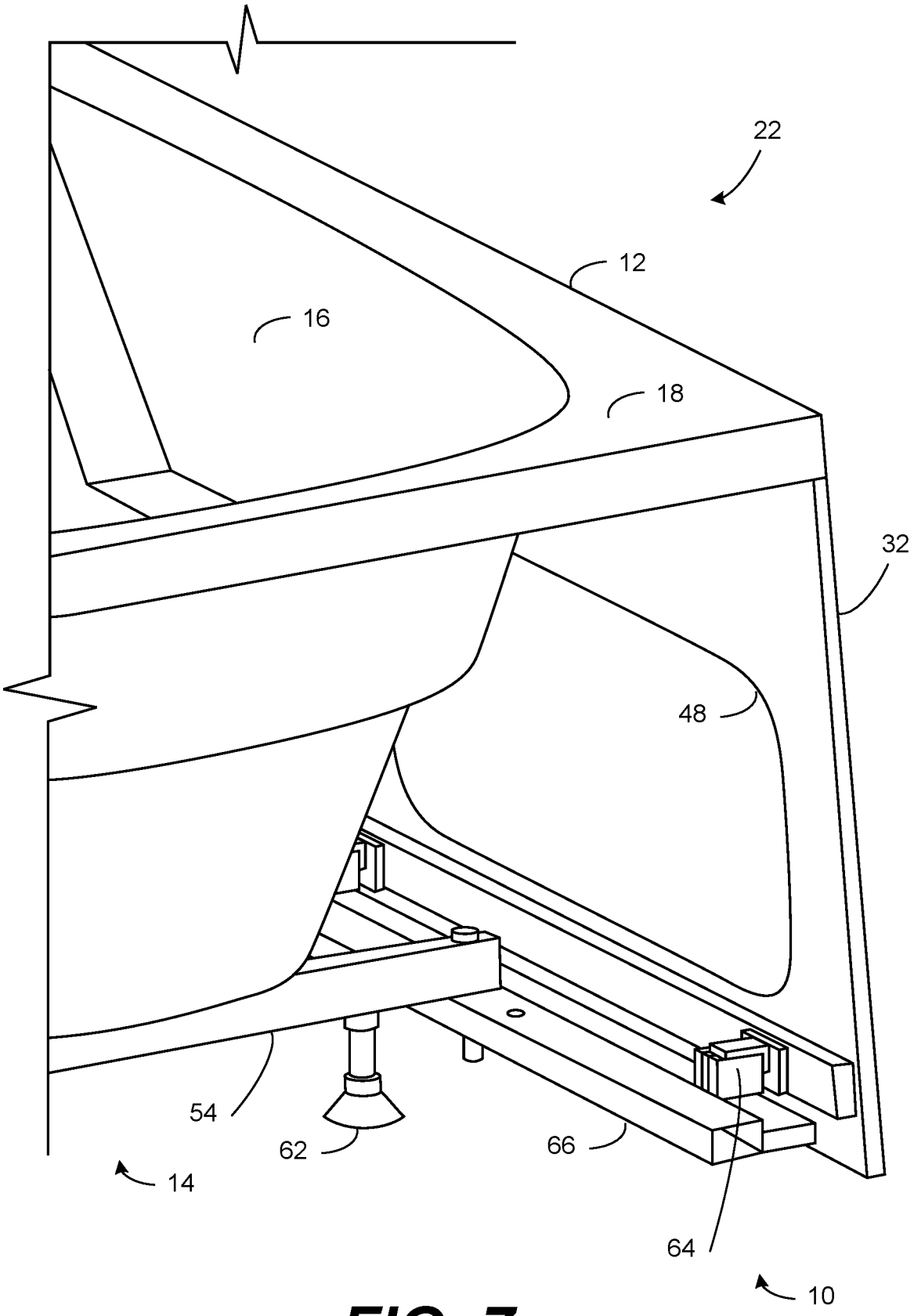
FIG. 7 is a front view of a bathtub apparatus according to an example embodiment.
Figure 8:
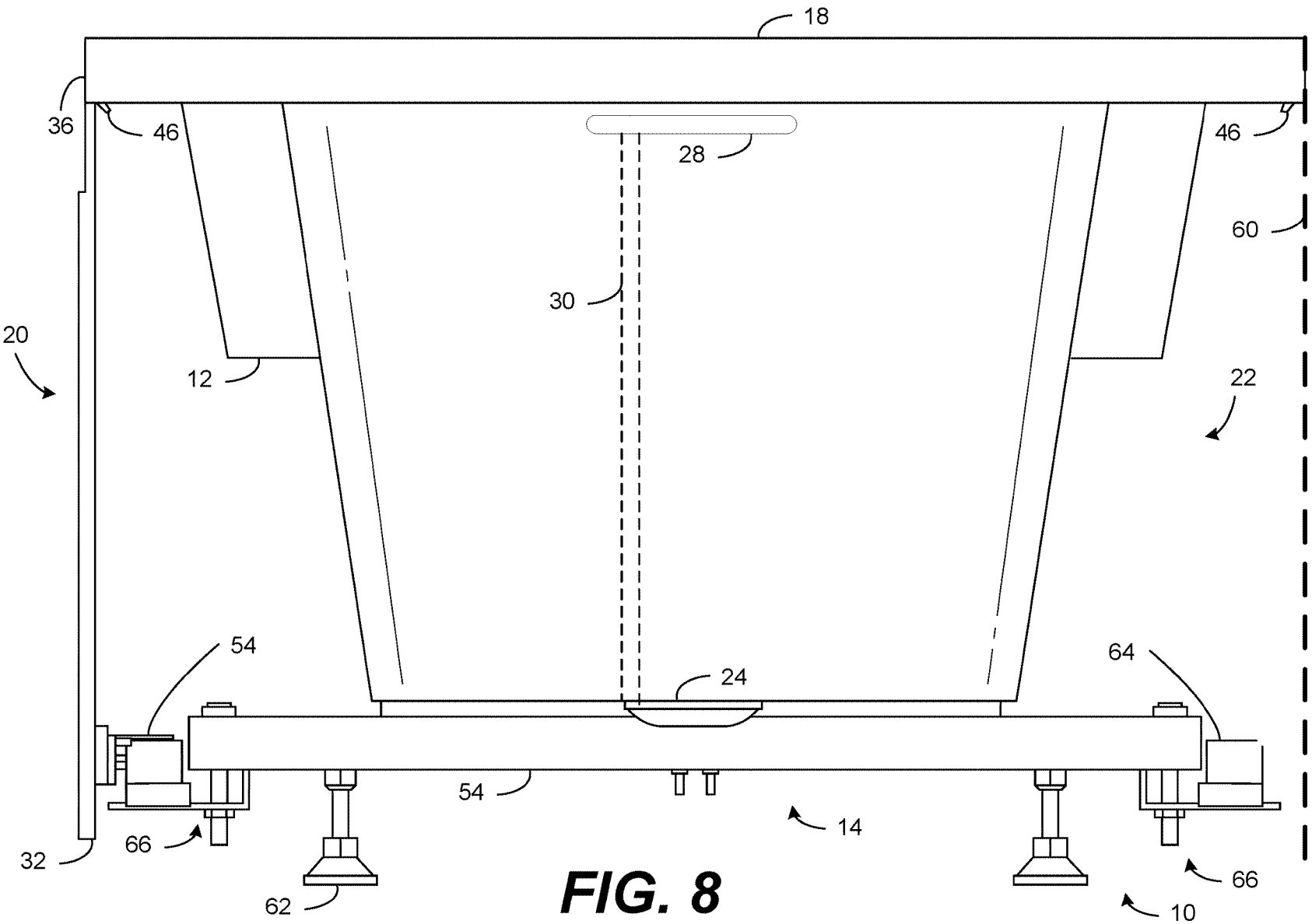
FIG. 8 is a front view of a bathtub apparatus according to an example embodiment.

In some embodiments, reversible side panel 32 is interchangeably coupled to either of the first side and the second side of the bathtub body by sliding a top edge (e.g., top edge 34) of interchangeably reversible side panel 32 under the edge (e.g., edge 36) of top 18 of bathtub body 12 on a respective side (e.g., either first side 20 or second side 22) of bathtub body 12 to define a generally flat surface across edge 36 of top 18 of bathtub body 12 and reversible side panel 32. Referring also to FIGS. 3-4, the process of coupling reversible side panel 32 to first side 20 of bathtub body 12 is shown by sliding top edge 34 of reversible side panel 32 under edge 36 of top 18 of bathtub body 12. As shown in FIGS. 3-4, by lifting reversible side panel 32 into contact with bathtub top 18 by sliding top edge 34 under edge 36 in the direction of arrow 38, reversible side panel 32 is coupled to top 18 of bathtub body 12. Referring also to FIG. 5 and in some embodiments, reversible side panel 32 is coupled to top 18 of either first side 20 or second side 22 of bathtub body 12 using one or more clips (e.g., clips 40, 42, 44, 46) mounted under edge 36 of top 18 of bathtub body 12. In one embodiment, clips 40, 42, 44, 46 include flange clips that receive top edge 34 of reversible side panel 32 and reversible side panel 32 against top 18. While examples of clips have been described, it will be appreciated that various types of fasteners (e.g., screws, bolts and nuts, staples, clamps, rivets, magnetic couplers, etc.) may be used within the present disclosure to couple reversible side panel 32 to top 18. Referring again to FIG. 4, with reversible side panel 32 coupled to bathtub body 12, the combination of top 18 and reversible side panel 32 define a generally flat and continuous surface on first side 20.

In some embodiments, reversible side panel 32 includes one or more removable access panels (e.g., removable access panels 48, 50). A removable access panel (e.g., removable access panels 48, 50) include apertures in reversible side panel 32 that are coverable with removable access panels 48, 50. For example, removal of reversible side panel 32 after installation may be undesirable when accessing components in the cavity defined behind reversible side panel 32 and under top 18 (e.g., drain 24, water jet system 26, etc.). Accordingly, reversible side panel 32 includes one or more removable access panels that are removable coupled to reversible side panel 32 using one or more fasteners. For example, various types of fasteners (e.g., screws, bolts and nuts, staples, clamps, rivets, magnetic couplers, etc.) may be used within the present disclosure to couple removable access panels 48, 50 to reversible side panel 32. As shown in FIGS. 3-4, the apertures within reversible side panel 32 are shown with removable access panels 48, 50 removed to facilitate coupling of reversible side panel 32 to bathtub body 12.

In some embodiments, bathtub body 12 includes a bottom-mounted support frame (e.g., bottom-mounted support frame 52) with a plurality of support frame rails (e.g., support frame rails 54, 56) defining, with bathtub body 12, a first plane (e.g., first plane 58) on first side 20 of bathtub body 12 for coupling reversible side panel 32 to first side 20 of bathtub body 12, and defining, with bathtub top 12, a second plane (e.g., second plane 60) on second side 22 of bathtub body 12 for coupling reversible side panel 32 to second side 22 of bathtub body 12. Bottom-mounted support frame 52 includes a plurality of support frame rails (e.g., support frame rails 54, 56) that extend outward from underneath bottom 14 of bathtub body 12 toward first side 20 on one end and toward second side 22 on the opposite end. As shown in FIGS. 2 and 5, support frame rails 54 and 56 extend outward perpendicularly from bottom 14 of bathtub body 12 toward first side 20 to define first plane 58 (a plane represented as a dashed lines between edge 36 of top 18 and the end of support frame rail 54) and toward second side 22 to define second plane 60 (a plane represented as dashed lines between the edge of top 18 and the opposite end of support frame rail 54). Bottom-mounted support frame 52 may include a plurality of mounting stands (e.g., represented generally with mounting stand 62) to lift bathtub body 12 off a ground surface.

In some embodiments, bathtub body 12 includes a top-mounted support frame (e.g., support frame 52) with a plurality of support frame rails (e.g., support frame rails 54, 56) that extend outward from the top-mounted support frame in a similar manner as describe above regarding a bottom-mounted support frame. In this example, top-mounted support frame 52 is mounted from top 18 or underneath top 18 with support frame rails 54, 56 extending outward perpendicularly from top 18 of bathtub body 12 toward first side 20 to define first plane 58 (a plane represented as a dashed lines between edge 36 of top 18 and the end of support frame rail 54) and toward second side 22 to define second plane 60 (a plane represented as dashed lines between the edge of top 18 and the opposite end of support frame rail 54). In some embodiments, bathtub body 12 includes a side-mounted support frame (e.g., support frame 52) with a plurality of support frame rails (e.g., support frame rails 54, 56) that extend outward from the side-mounted support frame in a similar manner as describe above regarding a bottom-mounted support frame. In this example, side-mounted support frame 52 is mounted at any height between bottom 14 and top 18 of bathtub body 12 with support frame rails 54, 56 extending outward perpendicularly from bathtub body 12. In some embodiments, side-mounted support frame 52 wraps around the periphery of bathtub body 12.

In some embodiments, reversible side panel 32 is interchangeably coupled to either of first side 20 or second side 22 of bathtub body 12 at any point or points of bathtub body 12. In this example, a combination of blocks, brackets, and/or other physical offsets may be coupled to bathtub body 12 to secure reversible side panel 32 in position of either of first side 20 or second side 22.

Figure 9:
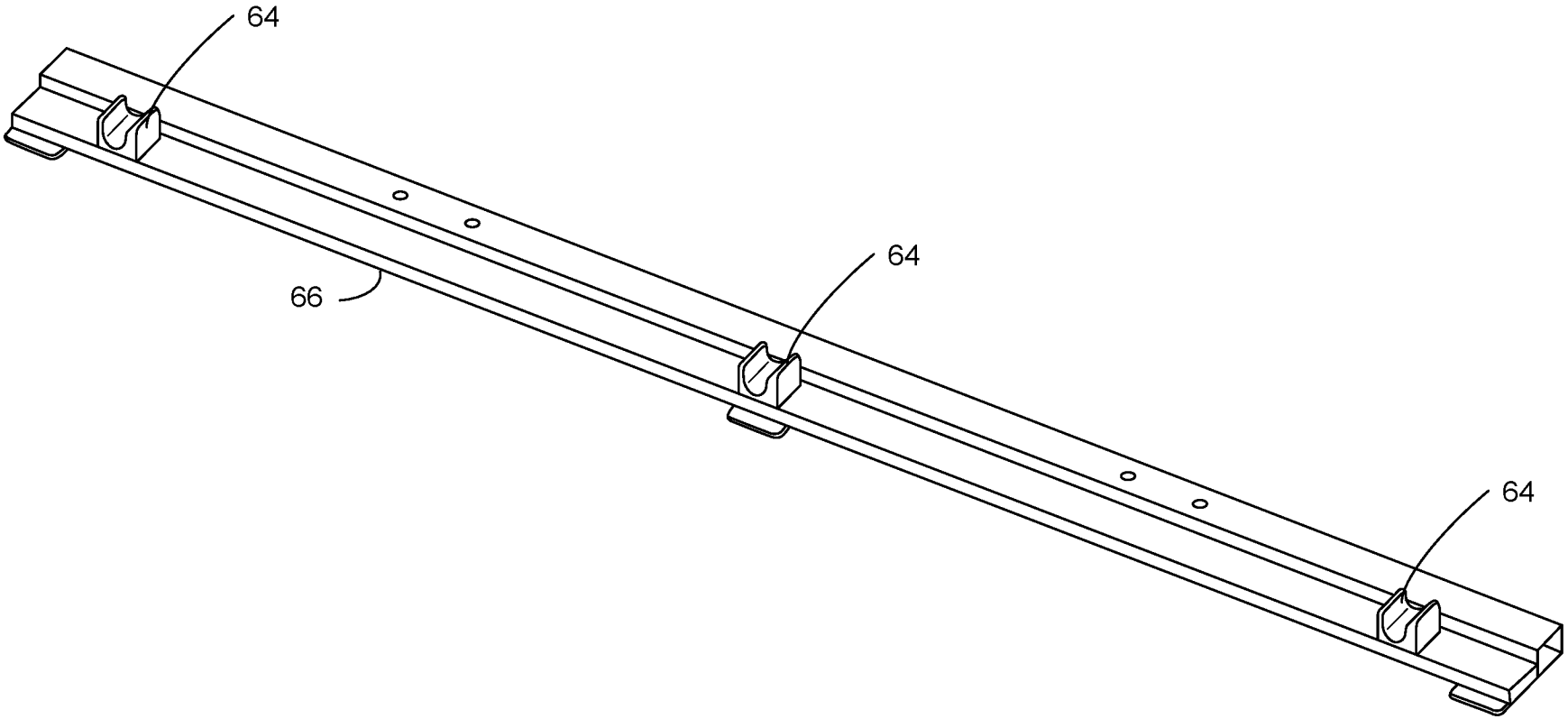
FIG. 9 is a perspective view of a bottom coupling rail according to an example embodiment.

In some embodiments, reversible side panel 32 is interchangeably coupled to a bottom of either of first side 20 or second side 22 of bathtub body 12 using a coupling mechanism (e.g., coupling mechanism 64) on at least one of support frame rails (e.g., support frame rails 54, 56). Coupling mechanism 64 is a fastener system (e.g., screws, bolts and nuts, staples, clamps, slotted buckles, rivets, magnetic couplers, etc.) that couples the bottom of reversible side panel 32 to support frame rails 54, 56 of bottom-mounted support frame 52. In some embodiments, coupling mechanism 64 may be directly coupled to the end of support frame rails 54, 56 (as shown in FIGS. 2, 5, 7-8, and 11) and/or may be coupled to a separate bottom coupling rail (e.g., bottom coupling rail 66) as shown in FIG. 9. Referring to FIG. 9, bottom coupling rail 66 includes a plurality of coupling mechanisms (e.g., represented generally as coupling mechanism 64) positioned along the length of bottom coupling rail 66. In some embodiments, bottom coupling rail 66 is coupled to an end of support frame rails 54, 56 as shown in FIG. 5 and extends perpendicularly to support frame rails 54, 56 to provide multiple coupling points with reversible side panel 32. As discussed above and in one embodiment, coupling mechanism 64 includes a magnetic coupling mechanism formed between a magnetic coupling portion on bottom portion of reversible side panel 32 and a corresponding magnetic coupling portion on at least one of support frame rails 54, 56 or a corresponding magnetic coupling portion positioned on bottom coupling rail 66.

Figure 10:
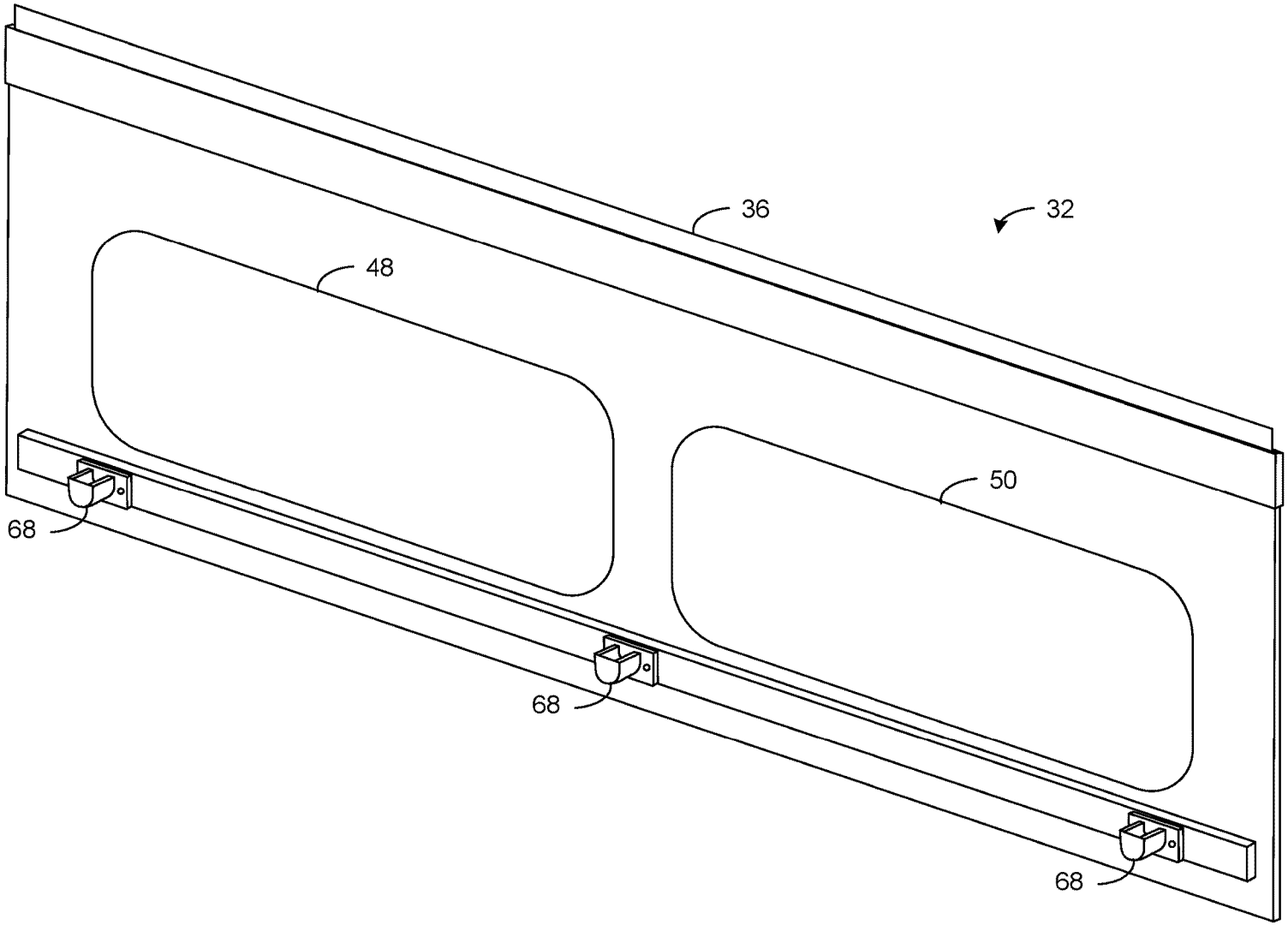
FIG. 10 is a perspective view of a reversible side panel according to an example embodiment.
Figure 11:
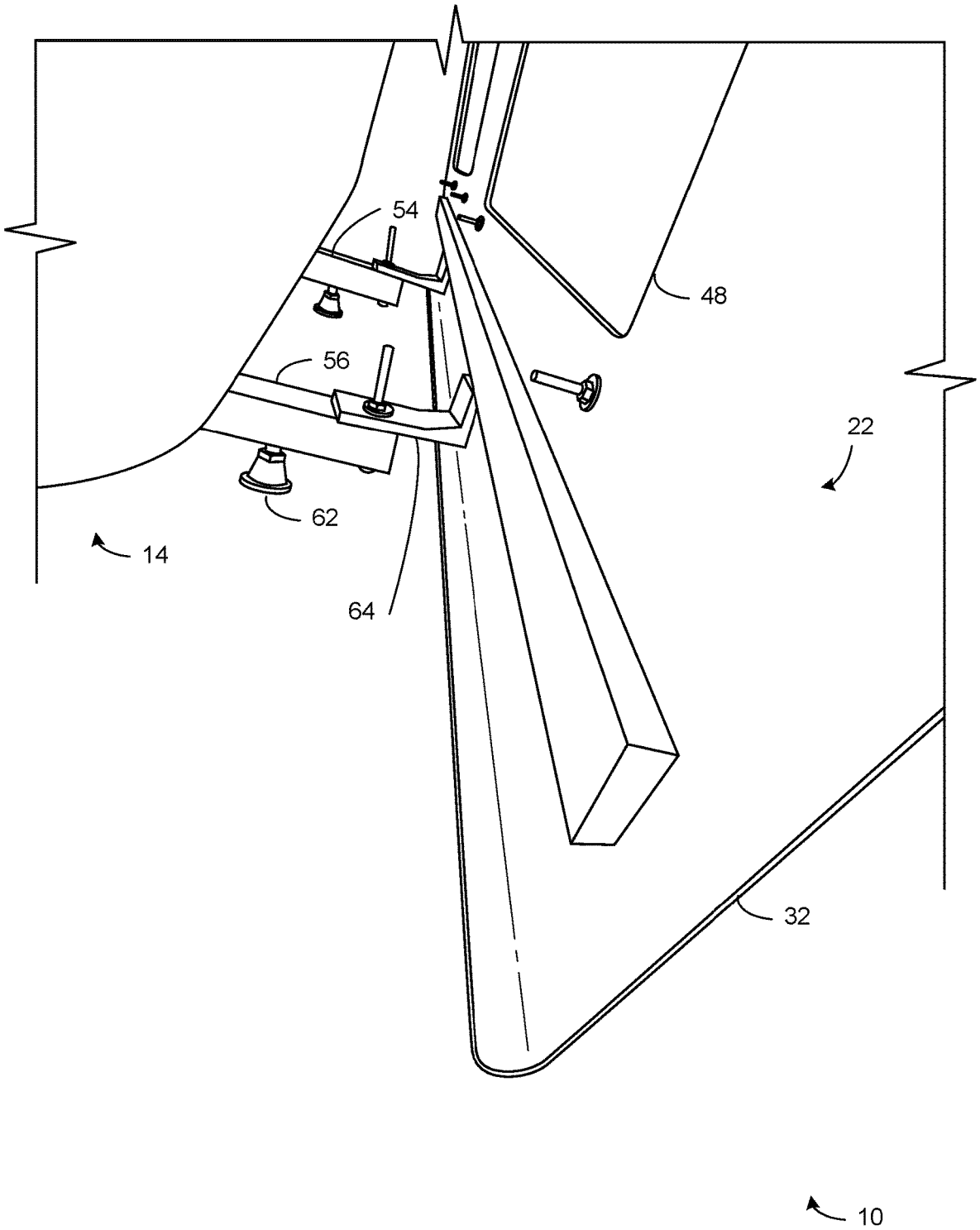
FIG. 11 is a front view of reversible side panel being coupled to a support frame rail of a bathtub body according to an example embodiment.

Referring also to FIG. 10 and in some embodiments, reversible side panel 32 includes a plurality of corresponding coupling mechanism portions (e.g., corresponding coupling mechanism portions 68) for coupling to coupling mechanism 64 (e.g., coupling mechanism portions of coupling mechanism 64). In one embodiment, coupling mechanism 64 is a buckle system with a plurality of female-end buckle portions that receive and engage plurality of corresponding coupling mechanism portions 68 of bottom coupling rail 66. Referring also to FIG. 11, coupling mechanism 64 includes a magnetic or metallic coupling portion that magnetically engages with a magnetic or metallic element in reversible side panel 32. In another embodiment, a screw fastener couples reversible side panel 32 to coupling mechanism 64. In one example and as shown in FIGS. 2 and 11, coupling mechanism 64 includes adjustable brackets that move vertically (i.e., along axis line 70) and/or horizontally (i.e., along axis line 72) to adjust the positioning of reversible side panel 32 for a secure coupling against bathtub body 12 and a ground surface/floor that bathtub 10 is positioned. Accordingly, it will be appreciated that various types and/or combinations of coupling mechanisms may be used within the scope of the present disclosure.

Referring again to FIGS. 2 and 8 and in some embodiments, coupling mechanism 64 may include adjustable brackets on both ends of support frame rails 54, 56 for installation of reversible side panel 32 on either side or both sides (e.g., first side 20 or second side 22). In one example, coupling mechanism 64 can be installed or removed during installation and/or removal of bathtub 10. In another example, coupling mechanism 64 is pre-installed on support frame rails 54, 56. In this example, a user or installer of bathtub 10 will only have to install reversible side panel 32 (as opposed to also installing coupling mechanism 64). However, it will be appreciated that coupling mechanism 64 may be added, adjusted, and/or removed during installation of bathtub 10 within the scope of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. A bathtub apparatus comprising:

a bathtub body including a bottom, an interior sidewall, a top, and a pair of opposing sides; and a reversible side panel configured to be interchangeably coupled to either of a first side and a second side of the bathtub body, wherein the first side and the second side define the pair of opposing sides of the bathtub body, wherein the reversible side panel is interchangeably coupled to either of the first side and the second side of the bathtub body by sliding a top edge of the interchangeably reversible side panel vertically upwards under an edge of the top of the bathtub body on a respective side of the bathtub body using at least one of: one or more clips, one or more staples, one or more clamps, one or more rivets, and one or more magnetic couplers mounted under the edge of the top of the bathtub body that receive the top edge of the interchangeably reversible side panel to define a flat surface across the edge of the top of the bathtub body and the reversible side panel.

2. The bathtub apparatus of claim 1, wherein the bathtub body includes a bottom-mounted support frame with a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body.

3. The bathtub apparatus of claim 2, wherein the reversible side panel is interchangeably coupled to a bottom of either of the first side and the second side of the bathtub body using a coupling mechanism on at least one of the support frame rails.

4. The bathtub apparatus of claim 3, wherein the coupling mechanism includes a magnetic coupling mechanism formed between a magnet positioned on a bottom portion of the reversible side panel and a magnet positioned on at least one of the support frame rails.

5. The bathtub apparatus of claim 1, wherein the bathtub body includes a drain positioned on a left side of the bathtub body extending through the bottom of the bathtub body.

6. The bathtub apparatus of claim 1, wherein the bathtub body includes a drain positioned on a right side of the bathtub body extending through the bottom of the bathtub body.

7. The bathtub apparatus of claim 1, wherein the reversible side panel includes one or more removable access panels.

8. The bathtub apparatus of claim 1, wherein the bathtub body includes an elongated aperture within the interior sidewall adjacent to the top of the bathtub body that extends through the interior sidewall of the bathtub body into an overflow channel coupled to a drain.

9. The bathtub apparatus of claim 1, wherein the reversible side panel is configured to be coupled to the first side of the bathtub body.

10. The bathtub apparatus of claim 1, wherein the reversible side panel is coupled to the first side of the bathtub body.

11. The bathtub apparatus of claim 1, wherein the reversible side panel is configured to be coupled to the second side of the bathtub body.

12. A bathtub apparatus comprising:

a bathtub body including a bottom, an interior sidewall, a top, and a pair of opposing sides; and a reversible side panel configured to be interchangeably coupled to either of a first side and a second side of the bathtub body, wherein the first side and the second side define the pair of opposing sides of the bathtub body, wherein the reversible side panel is interchangeably coupled to either of the first side and the second side of the bathtub body by sliding a top edge of the interchangeably reversible side panel vertically upwards under an edge of the top of the bathtub body on a respective side of the bathtub body such that the top edge of the interchangeably reversible side panel engages one or more flange clips mounted under a interior vertical face of the edge of the bathtub body that receive the top edge of the interchangeably reversible side panel to define a flat surface across the edge of the top of the bathtub body and the reversible side panel.

13. The bathtub apparatus of claim 12, wherein the bathtub body includes a bottom-mounted support frame with a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body.

14. The bathtub apparatus of claim 12, wherein the reversible side panel is interchangeably coupled to a bottom of either of the first side and the second side of the bathtub body using a coupling mechanism on at least one of the support frame rails.

15. The bathtub apparatus of claim 12, wherein the bathtub body includes a drain positioned on a left side of the bathtub body extending through the bottom of the bathtub body.

16. The bathtub apparatus of claim 12, wherein the bathtub body includes a drain positioned on a right side of the bathtub body extending through the bottom of the bathtub body.

17. A bathtub apparatus comprising:

a bathtub body including a bottom, a bottom-mounted support frame, an interior sidewall, a top, and a pair of opposing sides; and a reversible side panel configured to be interchangeably coupled to either of a first side and a second side of the bathtub body, wherein the first side and the second side define the pair of opposing sides of the bathtub body, wherein the reversible side panel is interchangeably coupled to either of the first side and the second side of the bathtub body by sliding a top edge of the interchangeably reversible side panel vertically upwards under an edge of the top of the bathtub body on a respective side of the bathtub body into one or more clips mounted under the edge of the top of the bathtub body that receive the top edge of the interchangeably reversible side panel to define a flat surface across the edge of the top of the bathtub body and the reversible side panel, wherein the bottom-mounted support frame includes a plurality of support frame rails defining, with the bathtub body, a first plane on the first side of the bathtub body for coupling the reversible side panel to the first side of the bathtub body and defining, with the bathtub top, a second plane on the second side of the bathtub body for coupling the reversible side panel to the second side of the bathtub body.

* * * * *